United States Patent [19]

Gijrath

[11] 4,065,693

[45] Dec. 27, 1977

[54] CATHODE RAY TUBE COLOR SELECTION ELECTRODE MOUNT

[75] Inventor: Johannes Henricus Nicolaas Gijrath, Eindhoven, Netherlands

[73] Assignee: U.S. Philips Corporation, New York, N.Y.

[21] Appl. No.: 722,097

[22] Filed: Sept. 10, 1976

[30] Foreign Application Priority Data

Sept. 18, 1975 Netherlands ..... 7510970

[51] Int. Cl.[2] ..... H01J 29/07; H01J 29/02

[52] U.S. Cl. ..... 313/406; 313/407

[58] Field of Search ..... 313/406, 404, 405, 407, 313/403, 408

[56] References Cited

U.S. PATENT DOCUMENTS

| | | | |
|---|---|---|---|
| 3,296,477 | 1/1967 | Shrader et al. | 313/407 |
| 3,501,663 | 3/1970 | Burdick | 313/406 |

*Primary Examiner*—Robert Segal

*Attorney, Agent, or Firm*—Frank R. Trifari

[57] ABSTRACT

A cathode ray tube construction and more particularly a supporting structure for the color selection electrode of a color television tube. The color selection electrode is formed with a frame member to the outer periphery of which is secured a mounting strip which engages a stud formed as part of the envelope. The mounting strip is formed with a lug portion which limits movement of the frame and a second portion which extends into the aperture of the frame allowing for easy insertion and removal of the frame.

4 Claims, 10 Drawing Figures

CATHODE RAY TUBE COLOR SELECTION ELECTRODE MOUNT

The invention relates to a cathode ray tube for displaying coloured pictures and comprising in an evacuated envelope means to generate at least two electron beams, a display screen on a display window which forms a part of the wall of the envelope, inwardly projectng studs on an upright edge of the window, and a colour selection electrode at a small distance in front of the display screen, a frame supporting the colour selection electrode and having a side extending substantially parallel to the upright edge and against which strip-shaped resilient elements are provided with one end the other free end of which extends away from the supporting frame in the direction of the studs and that free end of which has a lug and an aperture cooperating with the stud.

Such a cathode ray tube is known from U.S. Pat. No. 3,501,663. In such tubes the display screen often consists of areas in the form of a regular pattern of dots or stripes luminescing in red, green and blue. Such a pattern may be provided by a photographic method in which after a photographic layer which contains a phosphor of one colour, is deposited on the screen and then is exposed through the apertures in the colour selection electrode so that the pattern of the apertures of the colour selection electrode is "fixed" on the display screen in the form of phosphor stripes or dots. The colour selection electrode is then removed and the non-exposed material of the photographic layer is rinsed away. A fresh photographic layer is then provided which contains a phosphor of a different colour. By arranging the colour selection electrode again in front of the display screen and exposing by means of a displaced light source, new phosphor regions of a different colour in the form of the pattern of the apertures in the colour selection electrode are provided on the display screen beside the phosphor areas already present. This process is repeated for a third colour so that a regular pattern of dots or stripes in three different colours is obtained. It can be seen that it is desirable that the colour selection electrode can be placed in position in a simple, rapid and reproduceable manner for purposes of exposure can be removed for purposes of rinsing without being damaged, for example by hitting against the studs. In the said U.S. Pat. No. 3,501,663 this is prevented in that the strip-shaped resilient elements at their free end comprise a lug projecting in the direction of the display screen and positioned in such manner that upon placing the colour selection electrode the studs slide along said lugs into the apertures. A drawback of said construction is that upon providing the colour selection electrode the resilient elements which with their free end extend away from the supporting ring abut on the upright edge of the display window and/or the sealing collar of the studs and may damage same. Another drawback is that if the colour selection electrode during assembly slides on in that the stud jumps out of the aperture or slides along it, the display screen, the colour selection electrode and/or the phosphor already present are damaged.

According to the invention, a cathode ray tube of the kind described in the opening paragraph is characterized in that the lug projects through an aperture in the part of the supporting frame extending substantially parallel to the upright edge and presses against the inner side of said part when the colour selection electrode is not mounted in the cathode ray tube.

By securing the resilient element to the supporting frame in this manner, it extends less far from the supporting ring during assembly while sufficient tension force is present in it to obtain a good suspension of the colour selection electrode. As a result of this the resilient element impacts less rapidly on the upright edge of the display window, which in most of the cases is a ground edge which may not be damaged, so that a rapid assembly is possible without many auxiliary means. Since the lug extends in the direction of the display screen, the known guiding of the studs along the lugs into the apertures is obtained in addition.

Suitably, the sliding on can be reduced by a construction in which the free end comprises in addition a second lug which extends away from the display screen and is bent in such a manner that the stud is present between the display screen and the end of the second lug.

The colour selection electrode can be readily handled when in addition a lug extends away from the display screen from the free end of the resilient element and facilitates the compression of the spring manually upon inserting and removing the colour selection electrode.

The invention is by no means restricted to strip-shaped resilient elements of one material, for example invar; strip-shaped resilient elements of bimetal may be used.

The invention will now be described in greater detail with reference to the drawing, in which FIG. 1 shows a cathode ray tube, FIG. 2 shows a known resilient element, FIG. 3 shows a known resilient element mounted on a supporting frame.

Figure 8:
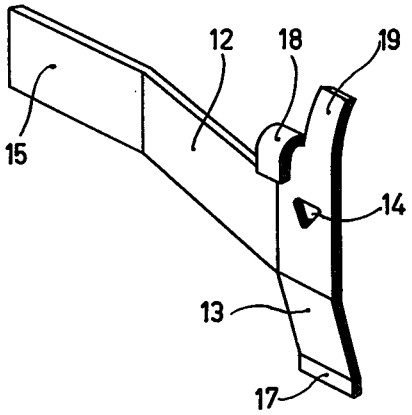
Figure 9:
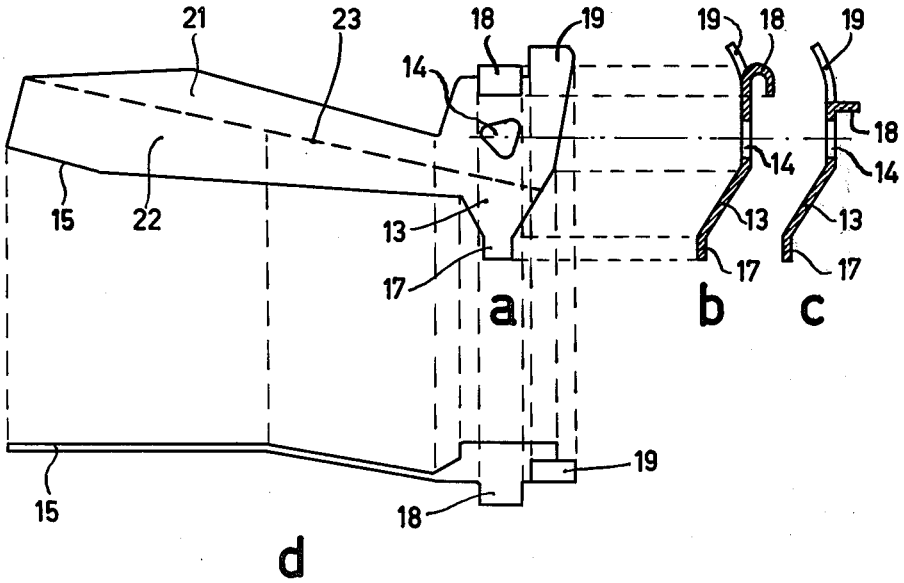

FIGS. *7a* and *7b* show a non-assembled and an assembled supporting frame each with a resilient element, FIG. 8 shows a resilient element and FIG. 9 shows a bimetallic resilient element.

Figure 1:
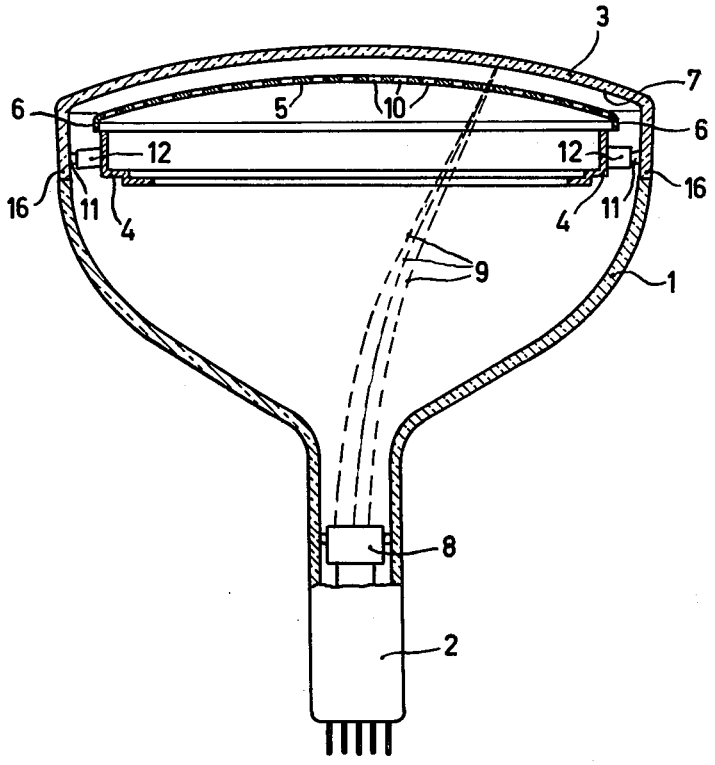
Figure 2:
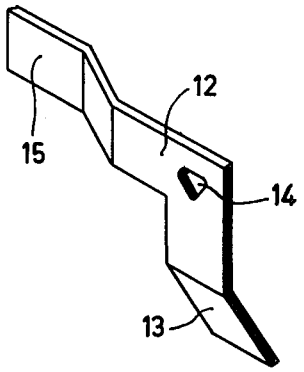
Figure 3:
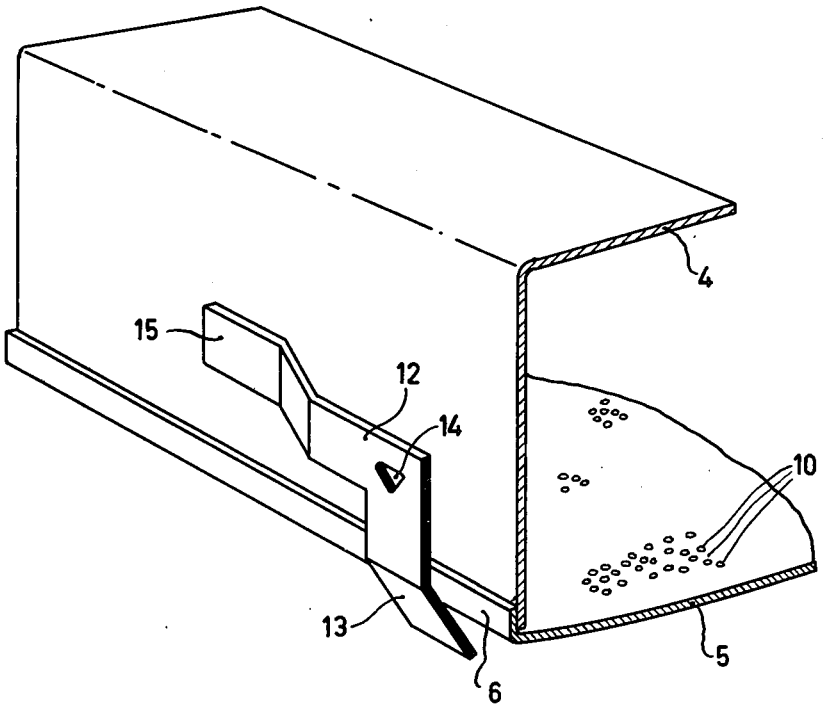

FIG. 1 shows a cathode ray tube consisting of an envelope 1 with a neck 2 opposite to which is a face plate 3 having a luminescent screen 7. A colour selection electrode in the form of a shadow mask 5 having an upright edge 6 is secured to a supporting frame 4. A means 8 generates three electron beams 9 which pass through the apertures in the shadow mask at a smalll angle known as the colour selection angle, with respect to each other, so that each impinges only upon luminescent areas of one colour. The screen has an upright edge which comprises inwardly projecting studs 11. The shadow mask is suspended near the display screen 5 by means of resilient elements 12 which are secured to the studs 11 and the supporting frame 4. The mask usually consists of a very thin metal sheet formed with apertures 10 which may be round or oblong. Alternatively, the mask may be composed of a wire grid. As already noted above, during the manufacture of the screen 7 the shadow mask 5 has to be inserted into and rmoved from the tube several times. In U.S. Pat. No. 3,501,663 the impact of the mask 5 against the studs 11 is prevented by the use of resilient elements 12, FIG. 2, each of which as shown in FIG. 3 is secured at an end 15 to the supporting frame 4, for example by spot welding. When the mask is mounted the stud 11 impacts on lug 13 of element 12 and slides along the lug into aperture 14. As a result of this the possibility of damage is decreased. Since the resilient elements 12 should have a certain resilience, their free ends with apertures 14 extend outwardly rather far thus including the possibility that the resilient elements 12 may impact on the upright edge 16 of the face plate 3 and/or the sealing collar of the stud 11 (see FIG. 7*b*) causing damage. Therefore all the resilient elements 12 should be depressed simultaneously during mounting the mask 5, which is rather complicated. The risk is also large that stud 11 slides over lug 13 and does not land in aperture 14 so that the mask 5 slides on probably resulting in damage to display screen 7 and the mask 5.

Figure 4:
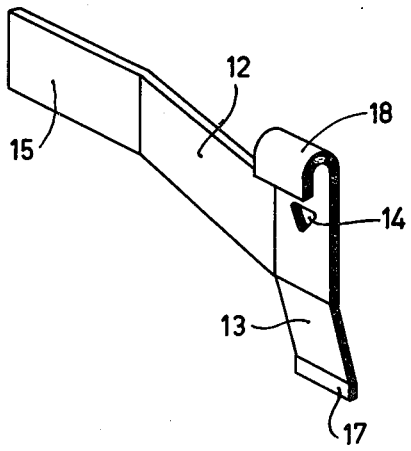
FIG. 4 shows a resilient element embodying the invention.
Figure 5:
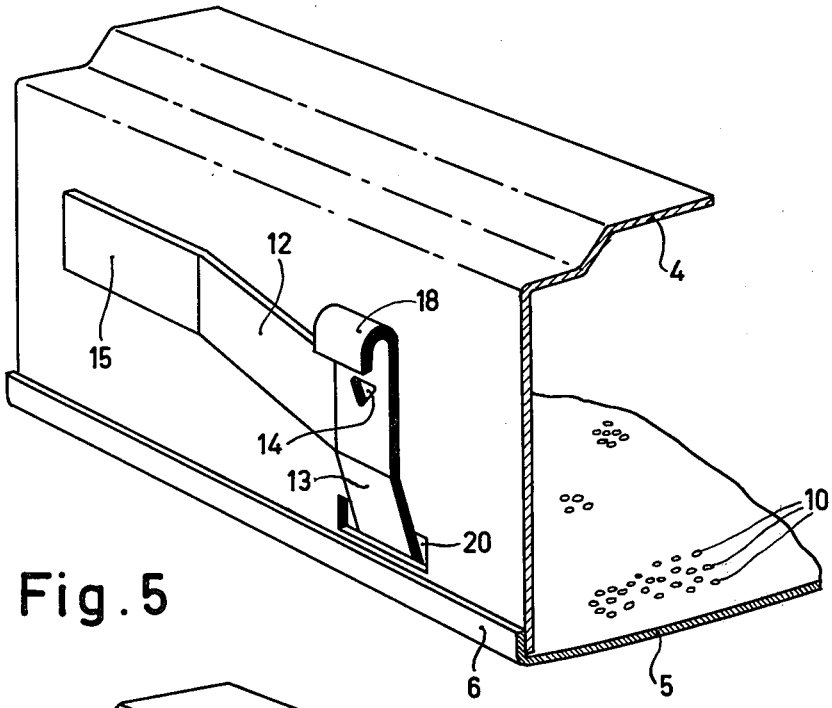
FIG. 5 shows a resilient element mounted on the supporting frame.
Figure 7:
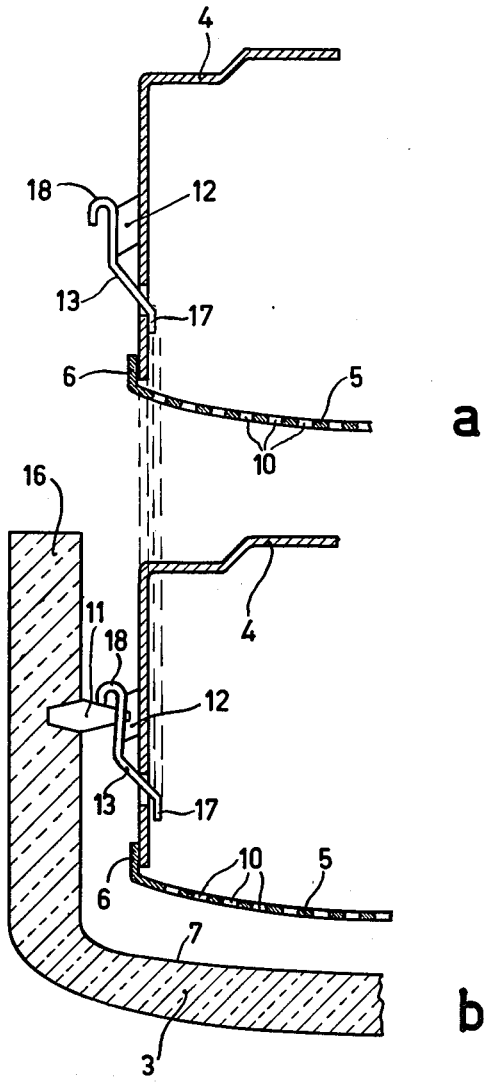

Referring now to the embodiment of the invention illustrated in FIGS. 4 and 5, resilient elements 12 each comprise a portion 13 which passes through an aperture 20 in the supporting frame 4 and the end 17 of which when the mask is not positioned in the tube 5 presses against the inside of the supporting frame 4, as shown in FIG. 7*a*. A lug 18 which in this case is bent through 180°, is provided to prevent sliding on. Alternatively, the lug may be bent at right angles. By providing the resilient elements 12 in this manner it has been found that usually it is when inserting the mask into the tube not necessary to press the elements towards the supporting frame, so that assembly is facilitated.

Figure 6:
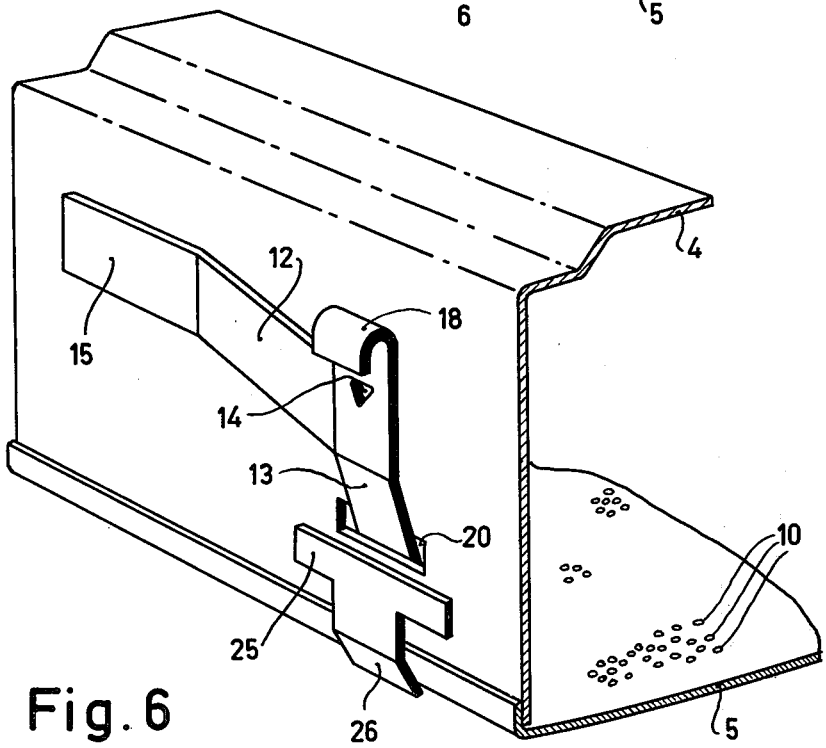
FIG. 6 shows an extra measure against damage of the colour selection electrode.

When the dimensions of the face plate and the mask are such that there is risk of the studs impacting against the mask a plate 25, which as shown in FIG. 6 forms part of the supporting frame, may be provided. A bent portion 26 of the plate extends in the direction of the face plate and serves to guide the studss 11 towards portion 13 of the resilient element.

FIGS. 7*a* and 7*b* show the mounting of the mask 5 behind the face plate 3. Stud 11 slides over portion 13 of the resilient element 12 and engages in aperture 14 (not visible). The end of lug 18 bears in this Figure on stud 11 but this is not essential since it only serves to prevent the mask 5 from sliding on. In FIG. 7*a* the end 17 of the resilient element 12 presses against the supporting frame 4 so that said resilient element in FIG. 7*b* has a sufficiently large tension force to fasten the frame in the tube.

The element 12 may be provided with an extra lug 19, shown in FIG. 8, which facilitates the insertion and removel of the mask 5.

The resilient element shown in FIG. 9 consists of two strips 21 and 22, respectively of a nickel-iron alloy and a chromium-nickel-iron alloy which are welded together by a weld 23 so that the strips together constitute a bimetallic reslient element. In such a resilient element the direction of resilience is at right angles to the direction in which the element bends as a result of tenperature variation: such elements are used to compensate the effects of thermal expansion of the mask. Two possible shapes of lug 18 are shown.

What is claimed is:

1. A cathode ray tube for displaying color images, comprising an evacuated envelope having a display window portion, a display screen on said window portion, means for generating at least two electron beams for energizing said screen, said display window portion forming part of the wall of said envelope and being provided with inwardly projecting studs positioned on an upright edge portion thereof, a color selection electrode adjacent to and spaced from the display screen, a frame supporting the color selection electrode and having side wall portions extending substantially parallel to said upright edge portions, strip shaped resilient elements having one end thereof secured to the frame and having their free other ends extending away from the frame in the direction of the studs, the free end of each of said resilient elements being provided with an aperture for engaging said studs and comprising a lug portion limiting movement of said free end in a direction transverse to the stud and comprising a second portion projecting through an aperture in that part of the supporting frame which extends substantially parallel to the upright edge, said seocnd portion being biased to press against the inside of said supporting frame when the color selector electrode is not mounted in the cathode ray tube.

2. A cathode ray tube as claimed in claim 1, characterized in that the lug extends in the direction of the display screen.

3. A cathode ray tube as claimed in claim 1, characterized in that the free end in addition has a second lug which extends away from the display screen and is bent in such a manner that the stud is located between the display screen and the end of the second lug.

4. A cathode ray tube as claimed in claim 1, characterized in that the second lug extends from the free end away from the display screen.

* * * * *